US009348247B2

(12) United States Patent
Ida et al.

(10) Patent No.: US 9,348,247 B2
(45) Date of Patent: May 24, 2016

(54) TONER AND METHOD OF PRODUCING TONER

(71) Applicant: CANON KABUSHIKI KAISHA, Tokyo (JP)

(72) Inventors: Hayato Ida, Yokohama (JP); Takashi Hirasa, Yokohama (JP); Ryo Natori, Tokyo (JP); Junichi Tamura, Inagi (JP); Yuya Chimoto, Kawasaki (JP); Takaho Shibata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/886,077

(22) Filed: May 2, 2013

(65) Prior Publication Data

US 2013/0302731 A1 Nov. 14, 2013

(30) Foreign Application Priority Data

May 10, 2012 (JP) ..... 2012-108381

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01); *G03G 9/08764* (2013.01); *G03G 9/08795* (2013.01); *G03G 9/08797* (2013.01)

(58) Field of Classification Search
CPC ..... G03G 9/08755; G03G 9/08797; G03G 9/08795
USPC ..... 430/109.4
See application file for complete search history.

(56) References Cited

U.S. PATENT DOCUMENTS

| | | | | |
|---|---|---|---|---|
| 3,965,021 | A * | 6/1976 | Clemens et al. | 430/109.31 |
| 7,745,085 | B2 | 6/2010 | Ishiyama et al. | |
| 7,833,687 | B2 | 11/2010 | Kato et al. | |
| 7,906,264 | B2 | 3/2011 | Takahashi et al. | |
| 8,497,056 | B2 | 7/2013 | Sekikawa et al. | |
| 2003/0162110 | A1 | 8/2003 | Sacripante et al. | |
| 2005/0287464 | A1 | 12/2005 | Cheng et al. | |
| 2007/0134582 | A1 | 6/2007 | Moriya | |
| 2007/0218396 | A1* | 9/2007 | Tomita | 430/123.52 |
| 2008/0050669 | A1* | 2/2008 | Ohmura et al. | 430/109.4 |
| 2011/0065038 | A1 | 3/2011 | Sacripante et al. | |
| 2011/0281216 | A1* | 11/2011 | Qiu et al. | 430/137.14 |
| 2011/0300478 | A1* | 12/2011 | Sekikawa et al. | 430/108.1 |
| 2012/0040285 | A1 | 2/2012 | Shibata et al. | |
| 2013/0108955 | A1 | 5/2013 | Shibata et al. | |
| 2013/0196258 | A1 | 8/2013 | Inaba et al. | |
| 2013/0202998 | A1 | 8/2013 | Higashi et al. | |
| 2013/0302732 | A1 | 11/2013 | Ida et al. | |

FOREIGN PATENT DOCUMENTS

| | | | | |
|---|---|---|---|---|
| CN | 101114136 | A | 1/2008 | |
| CN | 101140431 | A | 3/2008 | |
| CN | 102334074 | A | 1/2012 | |
| CN | 103246179 | A | 8/2013 | |
| EP | 0 737 899 | * | 10/1996 | G03G 9/08 |
| JP | 6-175389 | A | 6/1994 | |
| JP | 10-73959 | A | 3/1998 | |
| JP | 2003-255601 | A | 9/2003 | |
| JP | 2005-275336 | A | 10/2005 | |
| JP | 2005-292362 | A | 10/2005 | |
| JP | 2006-11437 | A | 1/2006 | |
| JP | 2009-122171 | A | 6/2009 | |
| JP | 2011-65155 | A | 3/2011 | |

OTHER PUBLICATIONS

Chinese Office Action dated Feb. 27, 2015 in Chinese Application No. 201310170461.9.

* cited by examiner

*Primary Examiner* — Hoa V Le
(74) *Attorney, Agent, or Firm* — Fitzpatrick, Cella, Harper and Scinto

(57) ABSTRACT

An object of the present invention is to provide a toner that produces an excellent bending resistance in the output image and that also exhibits an excellent low-temperature fixability and an excellent storage stability. This toner includes a binder resin and a thermoplastic elastomer having a crystalline part, wherein the binder resin and the thermoplastic elastomer in the toner are compatible with each other and the toner has a crystalline part originating from the thermoplastic elastomer.

10 Claims, No Drawings

TONER AND METHOD OF PRODUCING TONER

BACKGROUND OF THE INVENTION

1. Field of the Invention

The present invention relates to a dry toner for use in electrophotographic systems and to a method of producing this toner.

2. Description of the Related Art

The applications of the image-forming methods in dry toner electrophotographic systems have become quite diverse in recent years as speed and image quality have increased and are no longer limited to use in office applications. An example of these applications is the print-on-demand (POD) field, while use in packaging applications, e.g., packaging printing, is also under investigation. Packaging printing requires a high durability in order to prevent the image from being destroyed even when the printed image undergoes bending, and investigations have been carried out in order to obtain a high printed image durability.

Japanese Patent Application Laid-open Nos. 2003-255601 and 2006-11437 introduce art that provides a substantial improvement in the bending resistance; this is achieved by incorporating a UV-curable material in the toner and carrying out exposure to UV after fixing. However, one problem here is that an image forming apparatus capable of carrying out UV irradiation has a complex structure and as a consequence is expensive. In addition, the UV cure becomes inadequate when the printing speed is raised and this also makes raising the printing speed problematic.

In Japanese Patent Application Laid-open No. 2011-65155, the attempt is made to increase the flexibility by reducing the particle diameter of the toner in order to reduce the thickness of the recording film; however, it is difficult just by reducing the recording film thickness to obtain a bending resistance sufficiently high to enable use in packaging printing applications.

Japanese Patent Application Laid-open Nos. H10-73959, 2009-122171, 2005-292362, H6-175389, and 2005-275336 disclose the addition of a thermoplastic elastomer to toner in order to inhibit fissuring of the toner in the developing device and in order to provide an excellent hot offset. However, due to the use of thermoplastic elastomer having a high softening point, the low-temperature fixability is impaired and a balance between the low-temperature fixability and the bending resistance of the output product is not achieved.

SUMMARY OF THE INVENTION

An object of the present invention is to provide a toner that exhibits an excellent low-temperature fixability and an excellent storage stability and that also produces an excellent bending resistance in the output image. A further object of the present invention is to provide a method of producing this toner.

The present inventors achieved the present invention as a result of intensive investigations in order to realize the aforementioned objects.

That is, the present invention is a toner including a binder resin and a thermoplastic elastomer, wherein a portion of the thermoplastic elastomer in the toner is compatible with the binder resin and a crystalline part originating from the thermoplastic elastomer is present in the toner.

As a result of investigations directed to providing the output image with an excellent bending resistance while maintaining the low-temperature fixability and storage stability, the present inventors discovered that it is effective in this regard to incorporate a binder resin and a thermoplastic elastomer in the toner and to generate a satisfactory compatibility between the two.

When the compatibility between the binder resin and the thermoplastic elastomer is unsatisfactory, the binder resin and thermoplastic elastomer are present in the output image in a state in which they are independent from each other. The brittle binder resin part in such a case is ruptured when the output image is bent. As a consequence, it is thought that even the addition of the thermoplastic elastomer is then not associated with an improvement in the bending resistance of the image as a whole.

When, on the other hand, the thermoplastic elastomer is made compatible with the binder resin, it is thought that the flexibility of the thermoplastic elastomer is then uniformly realized throughout the output image and this image is provided with an excellent bending resistance as a result.

However, when compatibility with the binder resin is brought about using a thermoplastic elastomer having a low softening point and being capable of low-temperature fixing, the glass transition temperature (also referred to simply as Tg in the following) of the toner is lowered and a declining trend appears in the storage stability and particularly in the blocking resistance (storage stability). Due to this, in order to increase the bending resistance of the output image, the low-temperature fixability, and the blocking resistance all at the same time, an increase in the blocking resistance must be devised while keeping a high compatibility between the binder resin and the thermoplastic elastomer.

As a result of intensive investigations by the present inventors, it was discovered that an excellent toner, which provides an excellent bending resistance for the output image and which also exhibits an excellent low-temperature fixability and an excellent blocking resistance, is obtained by having the thermoplastic elastomer be compatible with the binder resin and by retaining in the toner a crystalline part possessed by the thermoplastic elastomer.

While the reasons for this are not clear, it is thought that the Tg of the toner is lowered and an excellent low-temperature fixability is obtained by having the thermoplastic elastomer be compatible with the binder resin and that, in addition, an excellent blocking resistance is obtained due to limitations on the molecular mobility of the resin in the toner brought about by the crystalline part of the thermoplastic elastomer.

The present invention can thus provide a toner that exhibits an excellent low-temperature fixability and an excellent storage stability and that also produces an excellent bending resistance in the output image, and can also provide a method of producing this toner.

Further features of the present invention will become apparent from the following description of exemplary embodiments.

DESCRIPTION OF THE EMBODIMENTS

The toner of the present invention is a toner that includes a binder resin and a thermoplastic elastomer, wherein a portion of the thermoplastic elastomer in the toner is compatible with the binder resin and a crystalline part originating from the thermoplastic elastomer is present in the toner.

The binder resin in the present invention may be a known polymer ordinarily used in toners that is also compatible with the thermoplastic elastomer, vide infra.

Specifically, the following polymers can be used:

homopolymers of styrene and its substituted forms, e.g., polystyrene, poly-p-chlorostyrene, and polyvinyltoluene;

styrene copolymers, e.g., styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; as well as polyvinyl chloride, phenolic resins, naturally modified phenolic resins, natural resin-modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins, and petroleum resins. Polyester resins, which exhibit an excellent strength even at low molecular weights, are preferred among the preceding.

This polyester resin can be a polyester resin provided by the condensation polymerization of an alcohol monomer with a carboxylic acid monomer.

The alcohol monomer can be exemplified by the following:

alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; as well as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid, and their anhydrides; alkyl dicarboxylic acids such as succinic acid, adipic acid, sebacic acid, and azelaic acid, and their anhydrides; succinic acid substituted by a $C_{6-18}$ alkyl group or alkenyl group, and anhydrides thereof; and unsaturated dicarboxylic acids, e.g., fumaric acid, maleic acid, and citraconic acid, and their anhydrides.

The following monomers may also be used in addition to the preceding:

polyhydric alcohols such as glycerol, sorbitol, sorbitan, and the oxyalkylene ethers of, for example, novolac phenolic resins, as well as polybasic carboxylic acids such as trimellitic acid, pyromellitic acid, and benzophenonetetracarboxylic acid, and their anhydrides.

Particularly preferred among the preceding are resins provided by the condensation polymerization of a polyester unit component in which the dihydric alcohol monomer component is a bisphenol derivative represented by the following general formula (1) and the acid monomer component is a carboxylic acid component composed of a dibasic or higher basic carboxylic acid or anhydride thereof or lower alkyl ester thereof (for example, fumaric acid, maleic acid, maleic anhydride, phthalic acid, terephthalic acid, trimellitic acid, and pyromellitic acid).

[C1]

(1)

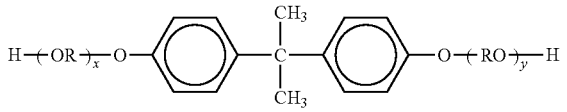

(In the formula, R represents an ethylene group or propylene group, x and y are both integers greater than or equal to 1, and the average value of x+y is 2 to 10.)

The compatibility between the binder resin and the thermoplastic elastomer can be determined by measuring the glass transition temperature (Tg) using a differential scanning calorimeter (DSC). When compatibility is absent, the Tg's for the binder resin and the thermoplastic elastomer are independently detected without a change in the Tg of the binder resin.

This glass transition temperature (Tg) is measured using a DSC (Mettler-Toledo International Inc.: DSC822/EK90). Specifically, 0.01 to 0.02 g of the specimen is weighed into an aluminum pan; the temperature is ramped up to 200° C. and cooling is performed from this temperature to 0° C. at a rate of decline of 10° C./min to provide a sample; and the amount of heat is measured while again ramping up the temperature of this sample at a ramp rate of 10° C./min. Using the resulting DSC curve, the glass transition temperature is then taken to be the temperature at the intersection of the straight line that extends the baseline on the low temperature side to the high temperature side, with the tangent line drawn at the point where the slope of the curve in the step transition region of the glass transition reaches a maximum.

When the compatibility between the binder resin and the thermoplastic elastomer is determined, the binder resin and the thermoplastic elastomer are mixed at a ratio of 100:30 and the glass transition temperature (Tg) is measured by the above method.

When in the present invention the binder resin and the thermoplastic elastomer are compatible, the Tg of the binder resin is reduced due to the compatibility because the Tg of the thermoplastic elastomer does not exceed room temperature. Due to this, the binder resin used in the present invention preferably has a Tg that is higher than that of the binder resins used in ordinary toners. Specifically, the Tg of the binder resin is preferably at least 60° C. and more preferably is from at least 65° C. to not more than 80° C.

The softening point (Tm) of the binder resin in the present invention is preferably from at least 70° C. to not more than 110° C., more preferably from at least 80° C. to not more than 110° C., and even more preferably from at least 80° C. to not more than 100° C. When the Tm is in the indicated temperature range, this sets up an excellent balance between the blocking resistance and the offset resistance and also causes there to be a proper amount of penetration by the toner melt component into the paper during the high temperature phase during fixing, resulting in an excellent surface smoothness and flatness.

Measurement of the softening point of the binder resin and thermoplastic elastomer, infra, was carried out in the present invention using a "Flow Tester CFT-500D Flow Characteristics Analyzer" (Shimadzu Corporation), which is a capillary rheometer that uses extrusion under a constant load. The CFT-500D is an instrument that raises the temperature of a measurement sample filled into a cylinder while applying a constant load from above using a piston, in order to melt the measurement sample and extrude it through a capillary orifice at the bottom of the piston, and that can graph the flow curve from the amount of piston travel (mm) and temperature (° C.) during this process.

In the present invention, the softening temperature (Tm) was taken to be the "melting temperature by the ½ method" described in the manual provided with the "Flow Tester CFT-500D Flow Characteristics Analyzer".

The melting temperature by the ½ method is calculated as follows.

First, ½ of the difference between the amount of piston travel at the completion of outflow (outflow completion point or Smax) and the amount of piston travel at the start of outflow (minimum point or 5 min) was determined (This is designated as X. X=(Smax−5 min)/2). The temperature in the flow curve when the amount of piston travel reaches the sum of X and 5 min was taken to be the melting temperature by the ½ method.

The measurement sample is prepared by subjecting approximately 1.2 g of the binder resin or thermoplastic elastomer to compression molding for approximately 60 seconds at approximately 10 MPa in a 25° C. environment using a tablet compression molder (for example, the Standard Manual Newton Press NT-100H from NPa SYSTEM CO., LTD.) to provide a cylindrical shape with a diameter of approximately 8 mm. The specific measurement procedure is carried out according to the manual provided with the instrument.

The measurement conditions with the Flowtester CFT-500D are as follows.

test mode: rising temperature method
start temperature: 60° C.
saturated temperature: 200° C.
measurement interval: 1.0° C.
ramp rate: 4.0° C./min
piston cross section area: 1.000 $cm^2$
test load (piston load): 5.0 kgf
preheating time: 300 seconds
diameter of die orifice: 1.0 mm
die length: 1.0 mm The binder resin preferably has an ionic group, i.e., a carboxylic acid group, sulfonic acid group, or amino group, in the resin skeleton and more preferably has a carboxylic acid group. The acid value of the binder resin is preferably from 3 to 35 mg KOH/g and more preferably is from 8 to 25 mg KOH/g. An excellent charge level is obtained in both high humidity environments and low humidity environments when the acid value of the binder resin is in the indicated range. The acid value is the number of milligrams of potassium hydroxide required to neutralize the free fatty acid, resin acid, and so forth present in 1 g of sample. Its measurement is carried out according to the measurement method in JIS K 0070.

Known thermoplastic elastomers that exhibit compatibility with the previously described binder resin and that have a crystalline part can be used without particular limitation as the thermoplastic elastomer in the present invention. The thermoplastic elastomer in the present invention refers to a resin that exhibits flowability upon the application of heat, rubbery elasticity at normal temperature, and an elongation at break at room temperature of at least 100%.

The presence/absence of a crystalline part in the thermoplastic elastomer can be determined from the crystallinity measured using wide-angle X-ray diffraction, and a crystalline part is judged to be present when a crystallinity of at least 1% is exhibited.

Viewed from the perspective of the blocking resistance, the crystallinity of the thermoplastic elastomer in the present invention is preferably at least 10% and more preferably is from at least 20% to not more than 60%.

The crystallinity can be measured under the following conditions using wide-angle X-ray diffraction.

X-ray diffraction instrument: D8 ADVANCE from Bruker AXS
X-ray source: Cu—Kα line (monochromated with a graphite monochromator)
output: 40 kV, 40 mA
slit system: slit DS, SS=1°, RS=0.2 mm
measurement range: 20=5° to 60°
step interval: 0.02°
scan rate: 1°/min Based on the measurement results, the X-ray diffraction profile of the sample is separated into crystalline peaks and amorphous scattering and the crystallinity is calculated from these areas using the following equation.

$$\text{crystallinity (\%)} = Ic/(Ic+Ia)\times 100$$

Ic: sum of the areas for the individual crystalline peaks
Ia: sum of the amorphous scattering areas The thermoplastic elastomer under consideration can be, for example, a styrenic thermoplastic elastomer, an olefinic thermoplastic elastomer, a vinyl chloride-type thermoplastic elastomer, a polybutadiene-type thermoplastic elastomer, a urethane thermoplastic elastomer, and so forth. A urethane thermoplastic elastomer is preferred from the standpoint of the ability to control the melting point of the crystalline part. This urethane thermoplastic elastomer can be exemplified by ester-type urethane thermoplastic elastomers and ether-type urethane thermoplastic elastomers.

An ester-type urethane thermoplastic elastomer has the structure indicated by the following general formula (2).

$$(\text{—O—R'—OCO—NH—R—NHCO—})n \quad (2)$$

R: aromatic hydrocarbon or aliphatic hydrocarbon
R': polyester

A specific example is the ester-type urethane thermoplastic elastomer produced by a polyaddition reaction between a diisocyanate and a polyester provided by the polycondensation of a polyhydric alcohol with a polybasic carboxylic acid such as adipic acid or terephthalic acid.

The diisocyanate can be exemplified by hexamethylene diisocyanate, tolylene diisocyanate, diphenylmethane diisocyanate, diphenyl dimethyl methane diisocyanate, dibenzyl diisocyanate, tetraalkyl diphenyl methane diisocyanate, diphenylmethane diisocyanate, naphthylene diisocyanate, trimethyl hexamethylene diisocyanate, trimethyl hexamethylene diisocyanate, cyclohexane-1,4-diisocyanate, xylylene diisocyanate, isophorone diisocyanate, dicyclohexyl methane-4,4'-diisocyanate, methylcyclohexane diisocyanate, hydrogenated diphenylmethane diisocyanate, tetramethyl xylylene diisocyanate, isophorone diisocyanate An ether-type urethane thermoplastic elastomer has the structure indicated by the following general formula (3).

$$(\text{—O—R'—OCO—NH—R—NHCO—})n \quad (3)$$

R: aromatic hydrocarbon or aliphatic hydrocarbon
R': polyether

A specific example is the ether-type urethane thermoplastic elastomer produced by reacting a diisocyanate with a difunctional polyether such as polyoxypropylene glycol (PPG) or polyoxytetramethylene glycol (PTMG). The above mentioned diisocyanates can be used as a diisocyanate.

When, for example, a polyester resin is used for the binder resin in the present invention, an ester-type urethane thermoplastic elastomer is then desirably selected for the thermoplastic elastomer from the standpoint of the compatibility with the polyester resin. Similarly, the binder resin and thermoplastic elastomer combination is desirably selected as appropriate in view of the compatibility between the binder resin and the thermoplastic elastomer.

With regard to the method of producing this thermoplastic elastomer having a crystalline part, production can be carried out in the present invention, for example, by the following procedure in the case of an ester-type urethane thermoplastic elastomer. Thus, the thermoplastic elastomer having a crystalline part can be obtained by polymerizing a polybasic carboxylic acid and a polyhydric alcohol to produce a polyester having a crystalline part and then submitting the obtained polyester having a crystalline part to a polyaddition reaction with a diisocyanate.

This polyester having a crystalline part can be produced by selecting a polybasic carboxylic acid and a polyhydric alcohol that readily generate crystallinity. A thermoplastic elastomer having a crystalline part is then obtained by subjecting this polyester having a crystalline part to a polyaddition reaction with a diisocyanate. Polybasic carboxylic acids that readily generate crystallinity can be exemplified by long-chain alkyl-type carboxylic acids such as adipic acid and sebacic acid. Polyhydric alcohols that readily generate crystallinity can be exemplified by long-chain alkyl-type diols such as butanediol and decanediol. In addition, the crystallinity of the thermoplastic elastomer having a crystalline part can be controlled using the compositional ratio of the crystallization-prone monomers.

The softening point of the thermoplastic elastomer is preferably less than or equal to the softening point of the binder resin in the present invention. When the softening point of the thermoplastic elastomer is higher than the softening point of the binder resin, the binder resin in the toner will melt first by itself during the fixing process and the bending resistance of the fixed product then declines. In addition, the softening point of the thermoplastic elastomer is more preferably from at least 60° C. to not more than the softening point of the binder resin. The blocking resistance tends to decline when the softening point of the thermoplastic elastomer is less than 60° C.

The melting point of the thermoplastic elastomer in the present invention is preferably from at least 40° C. to not more than 120° C. and more preferably is from at least 50° C. to not more than 100° C. When the melting point of the thermoplastic elastomer is in the indicated temperature range, the appearance of blocking can be inhibited and in addition an excellent low-temperature fixability can be obtained.

The elongation at break of the thermoplastic elastomer in the present invention is preferably in the range of 100% to 2000% and more preferably is in the range of 300% to 1200%. When the elongation at break is at least 100%, a suitable flexibility can be imparted to the fixed material and the bending resistance of the output image can be improved still further. In addition, the weight-average molecular weight of the thermoplastic elastomer is preferably at least 50,000, and in this case, just as for an elongation at break of at least 100%, a suitable flexibility can be imparted to the fixed material and the bending resistance of the output image can be improved still further.

The melting point of the thermoplastic elastomer can be measured using a differential scanning calorimeter (DSC). Specifically, 0.01 to 0.02 g of the sample is weighed into an aluminum pan and the amount of heat is measured while the temperature of the sample is ramped up from room temperature at a ramp rate of 10° C./min. The peak temperature of the endothermic peak in the obtained DSC curve is then taken to be the melting point.

Viewed from the perspective of balancing the bending resistance of the output image with the blocking resistance, the content of the thermoplastic elastomer in the present invention, expressed per 100 mass parts of the binder resin, is preferably from at least 20 mass parts to less than 100 mass parts and more preferably is from at least 30 mass parts to not more than 60 mass parts.

The toner of the present invention may as necessary contain, for example, a colorant and a release agent.

The colorant can be exemplified by known organic pigments and oil-soluble dyes, carbon blacks, and magnetic powders.

The cyan colorant includes, for example, copper phthalocyanine compounds and their derivatives, anthraquinone compounds, basic dye lake compounds, and so forth. Specific examples are C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

The magenta colorant includes, for example, condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

The yellow colorant includes, for example, compounds as represented by condensed azo compounds, isoindolinone compounds, anthraquinone compounds, azo metal complexes, methine compounds, and allylamide compounds. Specific examples are C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

The black colorant can be exemplified by carbon blacks, magnetic powders, and colorants adjusted to have a black color using the aforementioned yellow colorants, magenta colorants, and cyan colorants.

A single one of these colorants may be used or a mixture may be used or these colorants may be used in a solid solution state. The colorant is selected considering the hue angle, chroma, lightness, lightfastness, OHP transparency, and dispersibility in the toner.

The colorant content in the present invention is preferably from at least 1 mass part to less than 20 mass parts for each 100 mass parts of the total of the binder resin and thermoplastic elastomer.

The release agent can be exemplified by low molecular weight polyolefins such as polyethylenes; silicones that exhibit a melting point upon the application of heat; fatty acid amides such as oleamide, erucamide, ricinoleamide, and stearamide; ester waxes such as stearyl stearate; vegetable waxes such as carnauba wax, rice wax, candelilla wax, Japanese wax, and jojoba oil; animal waxes such as beeswax; mineral and petroleum waxes such as montan wax, ozokerite, ceresin, paraffin waxes, microcrystalline wax, Fischer-Tropsch waxes, and ester waxes; and modifications of the preceding.

The melting point of this release agent is preferably not more than 150° C., more preferably is from at least 40° C. to not more than 130° C., and particularly preferably is from at least 40° C. to not more than 110° C.

The content of this release agent is preferably from at least 10 mass parts to not more than 20 mass parts for each 100 mass parts of the total of the binder resin and thermoplastic elastomer.

The method of producing the toner of the present invention will now be considered. There is no particular limitation on the production method as long as the method used can bring about both compatibility between the thermoplastic elastomer and the binder resin and maintenance in the toner of the crystalline part originating from the thermoplastic elastomer. However, when an increase in the compatibility between the binder resin and the thermoplastic elastomer is pursued, the packing by the thermoplastic elastomer is impeded by the binder resin and the crystalline part then trends toward extinction. It is therefore crucial that the crystalline part originating from the thermoplastic elastomer remain present in the toner while the binder resin and the thermoplastic elastomer are made compatible.

It is quite difficult with the usual kneading pulverization methods to have the crystalline part originating from the thermoplastic elastomer remain present while at the same time securing compatibility between the thermoplastic elastomer and binder resin. The reason for this is as follows: for the combination of a thermoplastic elastomer that is compatible with the binder resin, the two can be compatibilized when high-shear kneading is performed; however, this extinguishes the crystalline part originating from the thermoplastic elastomer and the blocking resistance then declines. When, on the other hand, the shear force is reduced, the two do not become compatibilized and the bending resistance of the output image is reduced.

An emulsion aggregation method, on the other hand, is preferred because this method makes it possible to have the crystalline part of the thermoplastic elastomer remain present while at the same time securing compatibility between the binder resin and the thermoplastic elastomer.

This emulsion aggregation method is a production method in which the toner particles are produced by first preparing a dispersion of resin fine particles that are substantially smaller than the desired particle diameter and then aggregating these resin fine particles in an aqueous medium. Toner is produced in the emulsion aggregation method through a step of emulsifying resin fine particles, an aggregation step, a fusion step, a cooling step, and a washing step. As desired, a toner having a core/shell structure can also be prepared by adding a shell formation step.

A toner production method that uses emulsion aggregation is specifically described below, but this should not be taken to imply a limitation to this.

<The Step of Emulsifying Resin Fine Particles>

Resin fine particles are first prepared in the emulsion aggregation method. The resin fine particles may be produced by a known method, but are preferably produced by dissolving the binder resin and the thermoplastic elastomer in an organic solvent to form a homogeneous solution and then slowly adding an aqueous medium to this solution in order to precipitate the resin and produce resin fine particles. The use of this procedure to form the resin fine particles makes it possible to generate a compatible state between the binder resin and the thermoplastic resin while retaining the crystalline part of the thermoplastic elastomer. While the reason for this is unclear, it is thought that the compatibility is increased by dissolving the binder resin together with the thermoplastic elastomer and that the thermoplastic elastomer is crystallized by carrying out a slow precipitation. It is thought that the result of this is to provide an excellent blocking resistance and also an excellent bending resistance for the output image.

Specifically, the binder resin and thermoplastic elastomer are dissolved in an organic solvent and a surfactant and/or base is added. Then, while stirring with, for example, a homogenizer, an aqueous medium is slowly added and resin fine particles are precipitated. A dispersion of the resin fine particles is then produced by removing the solvent by heating or reducing the pressure. The organic solvent used to bring about dissolution may be any organic solvent that can dissolve the resins, but the use of an organic solvent that forms a homogeneous phase with water, e.g., tetrahydrofuran, is preferred from the standpoint of controlling resin compatibility.

There are no particular limitations on the surfactant used for emulsification, and this surfactant can be exemplified by anionic surfactants such as sulfate ester salts, sulfonic acid salts, carboxylic acid salts, phosphate esters, and soaps; cationic surfactants such as amine salts and quaternary ammonium salts; and nonionic surfactants such as polyethylene glycol types, ethylene oxide adducts on alkylphenols, and polyhydric alcohol types. A single surfactant may be used or two or more may be used in combination.

The base used in the emulsification can be exemplified by inorganic bases such as sodium hydroxide and potassium hydroxide and organic bases such as triethylamine, trimethylamine, dimethylaminoethanol, and diethylaminoethanol. A single base may be used or two or more may be used in combination.

The volume medium diameter of the resin fine particles is preferably from 0.05 to 1.0 μm and is more preferably from 0.05 to 0.4 μm. When this median diameter exceeds 1.0 μm, it then becomes difficult to obtain toner particles in the range from 4.0 to 7.0 μm, which is the favorable volume median diameter range for toner particles. The volume median diameter range can be measured using a dynamic light scattering particle size distribution analyzer (Nanotrac UPA-EX150 from NIKKISO CO., LTD.)

<The Aggregation Step>

The aggregation step is a step in which a liquid mixture is prepared by mixing, as necessary, colorant fine particles and/or release fine particles into the resin fine particles described above and then aggregating the particles present in the thusly prepared liquid mixture to form aggregates. In a favorable example of a method for forming the aggregates, for example, an aggregating agent is added to and mixed into the liquid mixture under the appropriate application of temperature, mechanical force, and so forth.

The colorant fine particles used in the aggregation step are prepared by dispersing the above-described colorant. The colorant fine particles can be dispersed by a known method, but, for example, a rotating shear-type homogenizer, a media-based dispersing device (e.g., a ball mill, a sand mill, an attritor, and so forth), or a high-pressure counter collision-type dispersing device is preferably used. In addition, a surfactant or polymeric dispersing agent that provides dispersion stability may be added as necessary.

The release agent fine particles used in the aggregation step are prepared by dispersing the above-described release agent in an aqueous medium. The release agent can be dispersed by a known method, but, for example, a rotating shear-type homogenizer, a media-based dispersing device (e.g., a ball mill, a sand mill, an attritor, and so forth), or a high-pressure counter collision-type dispersing device is preferably used. In addition, a surfactant or polymeric dispersing agent that provides dispersion stability may be added as necessary.

The aggregating agent used in the aggregation step can be exemplified by the metal salts of monovalent metals, e.g., sodium, potassium, and so forth; the metal salts of divalent metals, e.g., calcium, magnesium, and so forth; and the metal salts of trivalent metals, e.g., iron, aluminum, and so forth.

The addition and mixing of the aggregating agent is preferably carried out at a temperature that does not exceed the glass transition temperature (Tg) of the resin fine particles present in the mixed liquid. When this mixing is performed using this temperature condition, mixing then proceeds in a state in which aggregation is stable. This mixing may be carried out using a known mixing device, a homogenizer, a mixer, and so forth.

While there are no particular limitations on the average particle diameter of the aggregate formed in the aggregation step, this average particle diameter is generally favorably controlled to 4.0 μm to 7.0 μm so as to be about the same as the average particle diameter of the toner particles that will be obtained. This control is readily carried out by appropriately setting and varying the temperature during the addition and mixing of the aggregating agent and so forth and by appropriately setting and varying the conditions during the above-described stirring and mixing. The particle diameter distribution of the toner particles can be measured using a particle size distribution analyzer that employs the Coulter principle (Coulter Multisizer III: from Beckman Coulter, Inc.).

<The Fusion Step>

The fusion step is a step in which particles, provided by the smoothing of the aggregate surface, are produced by heating the aforementioned aggregates to at least the glass transition temperature (Tg) of the resin. In order to prevent melt adhesion between the toner particles, a chelating agent, a pH modifier, a surfactant, and so forth may be added prior to introduction into the primary fusion step.

The chelating agent can be exemplified by ethylenediaminetetraacetic acid (EDTA) and its salts with an alkali metal such as the Na salt, sodium gluconate, sodium tartrate, potassium citrate, sodium citrate, nitrilotriacetate (NTA) salts, and a number of water-soluble polymers that contain both the COOH and OH functionalities (polyelectrolytes).

The heating temperature should be between the glass transition temperature (Tg) of the binder resin present in the aggregates and the temperature at which the binder resin undergoes thermal decomposition. The time period for heating·fusion must be a shorter time when a higher heating temperature is used and a longer time when a lower heating temperature is used. That is, the heating·fusion time, while it cannot be unconditionally specified because it depends on the heating temperature, is generally from 10 minutes to 10 hours.

<The Cooling Step>

The cooling step is a step in which the temperature of the particle-containing aqueous medium is cooled to a temperature below the glass transition temperature (Tg) of the resin. Coarse particles are ultimately produced when cooling is not carried out to a temperature below the Tg. The specific cooling rate is from 0.1 to 50° C./min.

<The Washing and Drying Step>

The toner can be obtained by subjecting the particles prepared by the previously described steps to washing, filtration, drying, and so forth. This is followed by drying and as necessary the addition, with the application of shear force in the dry state, of inorganic particles, e.g., silica, alumina, titania, calcium carbonate, and so forth, and/or particles of a resin such as a vinyl resin, a polyester resin, a silicone resin, and so forth. These inorganic particles and resin particles function as an external additive such as, for example, a flowability aid, a cleaning aid, and so forth.

<The Shell Formation Step>

As necessary, a shell formation step can also be inserted after the fusion step and before the washing and drying step. The shell formation step is a step in which a shell is formed by the fresh addition and attachment of resin fine particles to the particles (also referred to as core particles) produced by the steps up to this point.

The binder resin fine particles added here may have the same structure as the binder resin fine particles used for the core particle or may be binder resin fine particles having a different structure.

There are no particular limitations on the resin constituting the shell layer, and the resins known for use in toner can be used, for example, polyester resins, vinyl polymers such as styrene-acrylic copolymers, epoxy resins, polycarbonate resins, and polyurethane resins. Polyester resins and styrene-acrylic copolymers are preferred among the preceding and polyester resins are more preferred from the standpoint of the fixing performance and durability. A polyester resin that has a rigid aromatic ring in the main chain has a flexibility comparable to that of vinyl polymers such as styrene-acrylic copolymers and as a consequence can provide the same mechanical strength at a lower molecular weight than a vinyl polymer. Due to this, polyester resins are also preferred as resins adapted for low-temperature fixability.

In the present invention, a single resin may be used to form the shell layer or a combination of two or more may be used.

The toner of the present invention can be produced using, for example, the production method described in the preceding. As noted above, the toner of the present invention is characterized by having a crystalline part originating from the thermoplastic elastomer. The presence/absence in the toner of the crystalline part originating from the thermoplastic elastomer is determined using the crystallinity measured using wide-angle X-ray diffraction as previously described. A crystalline part is determined to be present when this crystallinity for the thermoplastic elastomer in the toner is at least 1%.

This crystallinity is preferably from at least 1% to not more than 50% and more preferably is from at least 3% to not more than 30%. An improved blocking resistance is obtained when this crystallinity is at least 1%.

That this crystalline part originates from the thermoplastic elastomer can be confirmed in the present invention from the angle of the crystal diffraction peaks in the wide-angle X-ray measurements or by methods such as, for example, measurement of the relaxation time of the thermoplastic elastomer segment using solid-state NMR measurement.

The toner of the present invention preferably has a glass transition temperature (Tg), measured using the toner as the measurement sample, of from at least 20° C. to not more than 60° C. An excellent ability for the blocking resistance to coexist with the low-temperature fixability is achieved when this glass transition temperature is in the indicated range.

EXAMPLES

The present invention is more particularly described below using examples and comparative examples, but the modes of the present invention are not limited thereto. Unless specifically indicated otherwise, the number of parts and % in the examples and comparative examples are on a mass basis in all instances.

<Production of Resin Fine Particle 1>

50 g of a polyester resin A [composition (molar ratio)=polyoxypropylene(2.2)-2,2-bis(4-hydroxyphenyl)propane: isophthalic acid:terephthalic acid=100:50:50, number-average molecular weight (Mn)=4,600, weight-average molecular weight (Mw)=16,500, peak molecular weight (Mp)=10,400, Mw/Mn=3.6, softening point (Tm)=117° C., glass transition temperature (Tg)=70° C., acid value=13 mg KOH/g], 15 g of an ester-type urethane thermoplastic elastomer 1 [composition (molar ratio)=adipic acid:butanediol:tolylene diisocyanate=5:5:1, Mn=5,900, Mw=88,000, Mp=83,300, Mw/Mn=14.8, $T_m$=94° C., crystallinity=29%, melting point=46° C., elongation at break=700%], and 0.3 g of an anionic surfactant (Neogen RK from Dai-ichi Kogyo Seiyaku Co., Ltd.) were added to 200 g of tetrahydrofuran (Wako Pure Chemical Industries, Ltd.) and dissolution was effected by stirring for 12 hours. This was followed by the addition of 1.9 g of N,N-dimethylaminoethanol and stirring at 4,000 rpm using a T.K. ROBOMIX ultrahigh-speed stirrer (from the PRIMIX Corporation). 177.8 g of ion-exchanged water was additionally added at a rate of 1 g/min in order to precipitate resin fine particles. This was followed by removal of the tetrahydrofuran using an evaporator to yield resin fine particle 1.

Measurement of the volume median diameter of resin fine particle 1 using a dynamic light scattering particle size distribution analyzer (Nanotrac from NIKKISO CO., LTD.) gave 0.27 μm.

<Production of Resin Fine Particle 2>

A resin fine particle 2 was obtained proceeding as for the method of producing resin fine particle 1, but changing the amount of use of the ester-type urethane thermoplastic elastomer 1 to 7.5 g. The volume median diameter of the obtained resin fine particle 2 was 0.22 μm.

<Production of Resin Fine Particle 3>

A resin fine particle 3 was obtained proceeding as for the production of resin fine particle 1, but using a commercially available ester-type urethane thermoplastic elastomer [Pandex T5202 from DIC Corporation, Mn=7,900, Mw=213,000, Mp=177,000, Mw/Mn=26.8, $T_m$=162° C., melting point=48° C., elongation at break=600%, crystallinity=30%] in place of the ester-type urethane thermoplastic elastomer 1. The volume median diameter of the obtained resin fine particle 3 was 0.27 μm.

<Production of Resin Fine Particle 4>

A resin fine particle 4 was obtained proceeding as for the production of resin fine particle 1, but using a polyester resin B [composition (molar ratio)=polyoxypropylene(2.2)-2,2-bis(4-hydroxyphenyl)propane:polyoxyethylene(2.0)-2,2-bis(4-hydroxyphenyl)propane:terephthalic acid:fumaric acid:trimellitic acid=25:25:26:20:4, Mn=3,500, Mw=10,300, Mw/Mn=2.9, $T_m$=96° C., Tg=52° C., acid value=12 mg KOH/g] in place of the polyester resin A and using a commercially available ester-type urethane thermoplastic elastomer [Pandex T5205 from DIC Corporation, Mn=6,700, Mw=213,000, Mp=176,000, Mw/Mn=32.0, $T_m$=183° C., melting point=45° C., elongation at break=800%, crystallinity=21%] in place of the ester-type urethane thermoplastic elastomer 1. The volume median diameter of the obtained resin fine particle 4 was 0.33 μm.

<Production of Resin Fine Particle 5>

A resin fine particle 5 was obtained proceeding as for the production of resin fine particle 1, but using a polyester resin C [composition (molar ratio)=polyoxypropylene(2.2)-2,2-bis(4-hydroxyphenyl)propane:fumaric acid:dodecylsuccinic acid:terephthalic acid:trimellitic acid=100:32:32:32:4, Mn=27,900, Mw=50,600, Mw/Mn=1.8, $T_m$=116° C., Tg=56° C., acid value=27 mg KOH/g] in place of the polyester resin A. The volume median diameter of the obtained resin fine particle 5 was 0.29 μm.

<Production of Resin Fine Particle 6>

A resin fine particle 6 was obtained proceeding as for the production of resin fine particle 4, but using a commercially available polyester resin [Vylon GK-680 from TOYOBO CO., LTD., Mn=4,000, Mw=20,700, Mp=18,600, Mw/Mn=5.2, Tg=10° C., $T_m$=76° C.] in place of the ester-type urethane thermoplastic elastomer [Pandex T5205 from DIC Corporation]. The volume median diameter of the obtained resin fine particle 6 was 0.11 μm.

<Production of Resin Fine Particle 7>

50 g of polyester resin A, 15 g of a commercially available polybutadiene-type thermoplastic elastomer [JSRBR810 from JSR Corporation, Mn=15,000, Mw=221,500, Mp=134,000, Mw/Mn=14.8, $T_m$=140° C., crystallinity=20%, melting point=71° C.], and 3 g of an anionic surfactant (Neogen RK from Dai-ichi Kogyo Seiyaku Co., Ltd.) were added to 200 g of chloroform and dissolution was effected by stirring for 12 hours. This was followed by the addition of 1.9 g of N,N-dimethylaminoethanol and stirring at 4,000 rpm using a T.K. ROBOMIX ultrahigh-speed stirrer (from the PRIMIX Corporation). 600 g of ion-exchanged water was added dropwise and dispersion was carried out using a Nanomizer high-pressure ejection-type disperser (from YOSHIDA KIKAI CO., LTD.) and the chloroform was removed using an evaporator to yield resin fine particle 7. Measurement of the volume median diameter of resin fine particle 7 using a dynamic light scattering particle size distribution analyzer (Nanotrac from NIKKISO CO., LTD.) gave 0.18 μm.

<Production of Colorant Fine Particles>

| | |
|---|---|
| colorant (cyan pigment, Pigment Blue 15:3 from DAINICHISEIKA COLOR & CHEMICALS MFG. CO., LTD.) | 10.0 mass parts |
| anionic surfactant (Neogen RK from Dai-ichi Kogyo Seiyaku Co., Ltd.) | 1.5 mass parts |
| ion-exchanged water | 88.5 mass parts |

The preceding were mixed and dissolved and were dispersed for about 1 hour using a Nanomizer high-pressure impact-type disperser (from YOSHIDA KIKAI CO., LTD.) to produce an aqueous dispersion of colorant fine particles provided by dispersing the colorant. Measurement of the volume median diameter of the obtained colorant fine particles using a dynamic light scattering particle size distribution analyzer (Nanotrac from NIKKISO CO., LTD.) gave 0.20 μm.

<Production of Release Agent Fine Particles>

| | |
|---|---|
| release agent (behenyl behenate, melting point = 75° C.) | 10.0 mass parts |
| anionic surfactant (Neogen RK from Dai-ichi Kogyo Seiyaku Co., Ltd.) | 1.0 mass part |
| ion-exchanged water | 89.0 mass parts |

The preceding were introduced into a stirrer-equipped mixing vessel and were heated to 90° C. and a dispersion treatment was performed for 60 minutes by stirring under the following conditions while circulating to a Clearmix W-Motion (from M Technique Co., Ltd.) having a shear agitation section with a rotor outer diameter of 3 cm and a clearance of 0.3 mm: rotor rotation rate=19,000 r/min, screen rotation rate=19,000 r/min. This was followed by cooling to 40° C. using the following cooling conditions to obtain an aqueous dispersion of release agent fine particles: rotor rotation rate=1,000 r/min, screen rotation rate=0 r/min, cooling rate=10° C./min. Measurement of the volume median diameter of the obtained release agent fine particles using a dynamic light scattering particle size distribution analyzer (Nanotrac from NIKKISO CO., LTD.) gave 0.15 μm.

<Production of Toner 1>

| | |
|---|---|
| resin fine particles 1 | 10.0 mass parts |
| colorant fine particles | 0.5 mass parts |
| release agent fine particles | 1.0 mass part |
| 1.5 mass % aqueous magnesium sulfate solution | 10.0 mass parts |
| ion-exchanged water | 78.5 mass parts |

The preceding were mixed and then dispersed using a homogenizer (ULTRA-TURRAX T50 from IKA). The pH was then adjusted to 8.1 using a 0.1 mol/L aqueous sodium hydroxide solution. Heating to 45° C. was subsequently performed on a heating water bath while stirring with a stirring blade. After holding for 1 hour at 45° C., the formation of aggregate particles having an average particle diameter of about 5.5 μm was confirmed upon observation with an optical microscope. 40 mass parts of a 5 mass % aqueous trisodium citrate solution was added; the temperature was then raised to 85° C. while continuing to stir; and holding was carried out for 120 minutes in order to induce fusion of the core particles. Then, while continuing to stir, water was introduced into the water bath and cooling to 25° C. was performed. Measurement of the particle diameter of the core particles using a particle size distribution analyzer based on the Coulter principle (Coulter Multisizer III from Beckman Coulter, Inc.) gave a volume median diameter of 5.5 μm.

Then, after filtration and solid-liquid separation, 800 mass parts of ion-exchanged water having a pH adjusted to 8.0 using sodium hydroxide was added to the solid fraction and stirring and washing was performed for 30 minutes. This was followed by another filtration and solid-liquid separation. 800 mass parts of ion-exchanged water was then added to the solid fraction and stirring and washing was performed for 30 minutes. Another filtration and solid-liquid separation was thereafter carried out and this was repeated five times. The obtained solid fraction was subsequently dried to obtain toner 1.

The obtained toner 1 had a volume median diameter of 5.4 μm; a partial compatibility between the binder resin and the thermoplastic elastomer was present in toner 1; and the crystallinity originating from the thermoplastic elastomer in toner 1 was 3%.

<Production of Toner 2>

A toner 2 was obtained proceeding as in the method of producing toner 1, with the exception that resin fine particle 2 was used in place of resin fine particle 1. The volume median diameter of the obtained toner 2 was 5.6 μm; a partial compatibility between the binder resin and the thermoplastic elastomer was present in toner 2; and the crystallinity originating from the thermoplastic elastomer in toner 2 was 2%.

<Production of Toner 3>

A toner 3 was obtained proceeding as in the method of producing toner 1, with the exception that resin fine particle 3 was used in place of resin fine particle 1. The volume median diameter of the obtained toner 3 was 5.8 μm; a partial compatibility between the binder resin and the thermoplastic elastomer was present in toner 3; and the crystallinity originating from the thermoplastic elastomer in toner 3 was 3%.

<Production of Toner 4>

A toner 4 was obtained proceeding as in the method of producing toner 1, with the exception that resin fine particle 4 was used in place of resin fine particle 1. The volume median diameter of the obtained toner 4 was 5.6 μm; the binder resin and the thermoplastic elastomer were compatible in toner 4; and the crystallinity originating from the thermoplastic elastomer in toner 4 was 2%.

<Production of Toner 5>

A toner 5 was obtained proceeding as in the method of producing toner 1, with the exception that resin fine particle was used in place of resin fine particle 1. The volume median diameter of the obtained toner 5 was 5.5 μm; a partial compatibility between the binder resin and the thermoplastic elastomer was present in toner 5; and the crystallinity originating from the thermoplastic elastomer in toner 5 was 3%.

<Production of Toner 6>

A toner 6 was obtained proceeding as in the method of producing toner 1, with the exception that resin fine particle 6 was used in place of resin fine particle 1. The volume median diameter of the obtained toner 6 was 5.8 μm. In place of the thermoplastic elastomer, toner 6 contained a polyester resin having a low glass transition temperature, and the binder resin was compatible with the polyester resin having a low glass transition temperature.

<Production of Toner 7>

A toner 7 was obtained proceeding as in the method of producing toner 1, with the exception that resin fine particle 7 was used in place of resin fine particle 1. The volume median diameter of the obtained toner 7 was 5.4 μm. Compatibility between the binder resin and the thermoplastic elastomer was absent in toner 7, while the crystallinity originating from the thermoplastic elastomer in toner 7 was 10%.

<Production of Toner 8>

| | |
|---|---|
| polyester resin A | 100 g |
| ester-type urethane thermoplastic elastomer 1 | 30 g |
| colorant (cyan pigment, Pigment Blue 15:3 from DAINICHISEIKA COLOR & CHEMICALS MFG. CO., LTD.) | 6.5 g |
| release agent (behenyl behenate) | 13 g |

The preceding formulation was thoroughly mixed using a Henschel mixer and was kneaded using a twin-screw kneader set to a temperature of 130° C. The resulting kneaded material was cooled and coarsely pulverized to 2 mm and below using a hammer mill to obtain a coarsely pulverized material. This coarsely pulverized material was pulverized using a jet mill (Counter Jet Mill AFG from HOSOKAWA MICRON CORPORATION) and classified to obtain toner 8. The volume median diameter of the obtained toner 8 was 6.8 μm; the binder resin and the thermoplastic elastomer were compatible; and a crystalline part originating from the thermoplastic elastomer was not present.

Example 1

The evaluations described below were performed using toner 1. The results are given in Table 1.

Examples 2 to 5

The evaluations described below were performed using toners 2 to 5. The results are given in Table 1.

Comparative Examples 1 to 3

The evaluations described below were performed using toners 6 to 8. The results are given in Table 1.

<Evaluation of the Bending Resistance>1.8 mass parts of a hydrophobically-treated silica fine powder having a specific surface area measured by the BET method of 200 $m^2/g$ was dry mixed using a Henschel mixer (Mitsui Mining Co., Ltd.) into 100 mass parts of the toner to obtain an external-addition toner. The obtained external-addition toner and a ferrite carrier having a surface coated with a silicone resin (average particle diameter of 42 μm) were mixed to provide a toner concentration of 8 mass %, thereby producing a two-component developer. An unfixed toner image (0.6 $mg/cm^2$) was formed on an image-receiving paper (64 $g/m^2$) using a commercially available full color digital copier (CLC1100 from CANON INC.). The fixing unit was removed from a commercially available full color digital copier (imageRUNNER ADVANCE C5051 from CANON INC.) and was modified to make the fixation temperature adjustable, and the unfixed image was fixed at normal temperature and normal humidity using 180° C. for the roller temperature and 246 mm/sec for the process speed. The resulting fixed material was folded crosswise. The folding conditions were as follows: the folded part was moved back and forth five times while applying a load of 4.9 kPa with a flat weight. The bent image region was then rubbed five times back-and-forth with lens-cleaning paper to which a 4.9 kPa load was applied and the bent region was thereafter evaluated both by visual inspection and microscopic inspection. The results of the evaluation are given in Table 1.

(Evaluation Criteria)

A: Toner debonding is not seen under microscopic inspection.

B: Toner debonding is not seen on visual inspection, but debonding is observed under microscopic inspection.

C: Some toner debonding is seen on visual inspection.

D: Debonding of the majority of the toner is seen on visual inspection.

<Evaluation of the Storage Stability (Blocking Resistance)>

The external-addition toner was held for 2 weeks in a thermostat/humidistat at 40° C. and 95% humidity and the degree of blocking was then visually evaluated. The results of the evaluation are given in Table 1.

(Evaluation Criteria)

A: After the two week period, no blocking has been produced, or, if blocking has been produced, it is easily dispersed by light shaking.

B: Blocking has been produced after the two week period, but is dispersed by continuous shaking.

C: Blocking has been produced after the two week period and is not dispersed even upon the application of force.

<Evaluation of the Low-Temperature Fixability>

1.8 mass parts of a hydrophobically-treated silica fine powder having a specific surface area measured by the BET method of 200 $m^2/g$ was dry mixed using a Henschel mixer (Mitsui Mining Co., Ltd.) into 100 mass parts of the toner to obtain an external-addition toner. The obtained external-addition toner and a ferrite carrier having a surface coated with a silicone resin (average particle diameter of 42 μm) were mixed to provide a toner concentration of 8 mass %, thereby producing a two-component developer. An unfixed toner image (0.6 $mg/cm^2$) was formed on an image-receiving paper (64 $g/m^2$) using a commercially available full color digital copier (CLC1100 from CANON INC.). The fixing unit was removed from a commercially available full color digital copier (imageRUNNER ADVANCE C5051 from CANON INC.) and was modified to make the fixation temperature adjustable, and this was used to carry out a fixing test on the unfixed image. The condition was visually evaluated when the unfixed image was fixed at normal temperature and normal humidity using 246 mm/sec for the process speed. The results of the evaluation are given in Table 1.

(Evaluation Criteria)

A: Fixing was possible at a temperature of 140° C. or less.

B: Fixing was possible at a temperature higher than 140° C., but less than or equal to 160° C.

C: Fixing was possible at a temperature above 160° C. or no fixing region existed.

TABLE 1

| | | | binder resin | | | thermoplastic elastomer | | presence/ absence of | thermoplastic elastomer | results | | |
|---|---|---|---|---|---|---|---|---|---|---|---|---|
| | toner | resin fine particles | resin | Tm (° C.) | Tg (° C.) | Tm (° C.) | compatibility | crystalline part | content (mass parts) | bending resistance | storage stability | low-temperature fixability |
| Ex. 1 | toner 1 | resin fine particle 1 | polyester resin A | 117 | 70 | 94 | excellent | present | 30 | A | A | A |
| Ex. 2 | toner 2 | resin fine particle 2 | polyester resin A | 117 | 70 | 94 | excellent | present | 15 | B | A | A |
| Ex. 3 | toner 3 | resin fine particle 3 | polyester resin A | 117 | 70 | 162 | excellent | present | 30 | C | A | B |
| Ex. 4 | toner 4 | resin fine particle 4 | polyester resin B | 96 | 52 | 183 | excellent | present | 30 | C | B | B |
| Ex. 5 | toner 5 | resin fine particle 5 | polyester resin C | 116 | 56 | 94 | excellent | present | 30 | B | B | A |
| Comp. Ex. 1 | toner 6 | resin fine particle 6 | polyester resin B | 96 | 52 | — | excellent | absent | — | D | A | A |

TABLE 1-continued

| | toner | resin fine particles | binder resin: resin | binder resin: Tm (° C.) | binder resin: Tg (° C.) | thermoplastic elastomer Tm (° C.) | compatibility | presence/absence of crystalline part | thermoplastic elastomer content (mass parts) | results: bending resistance | results: storage stability | results: low-temperature fixability |
|---|---|---|---|---|---|---|---|---|---|---|---|---|
| Comp. Ex. 2 | toner 7 | resin fine particle 7 | polyester resin A | 117 | 70 | 140 | poor | present | 30 | D | A | C |
| Comp. Ex. 3 | toner 8 | — | polyester resin A | 117 | 70 | 94 | excellent | absent | 30 | B | C | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-108381, filed May 10, 2012, which is hereby incorporated by reference herein in its entirety.

What is claimed is:

1. A toner comprising a binder resin and a thermoplastic elastomer, wherein, the thermoplastic elastomer has a glass transition temperature (Tg) which does not exceed room temperature, the thermoplastic elastomer comprises a portion which is compatible with the binder resin, the toner comprises a crystalline part originating from the thermoplastic elastomer, the binder resin has a glass transition temperature of at least 60° C. and the softening point of the thermoplastic elastomer is less than or equal to the softening point of the binder resin, and the thermoplastic elastomer is an ester-type urethane thermoplastic elastomer.

2. The toner according to claim 1, wherein the melting point of the thermoplastic elastomer is from at least 40° C. to not more than 120° C.

3. The toner according to claim 1, wherein the thermoplastic elastomer has an elongation at break of 100% to 2000%.

4. The toner according to claim 1, wherein the content of the thermoplastic elastomer is from at least 20 mass parts to less than 100 mass parts per 100 mass parts of the binder resin.

5. The toner according to according to claim 1, wherein the crystallinity of the thermoplastic elastomer in the toner is from at least 1% to not more than 50%.

6. The toner according to claim 1, wherein the toner is a toner produced via the steps of:

producing resin fine particles by dissolving the binder resin and the thermoplastic elastomer in an organic solvent and adding water to the resulting solution; and aggregating the obtained resin fine particles in an aqueous medium.

7. The toner according to claim 6, wherein the organic solvent is an organic solvent that forms a homogeneous phase with water.

8. A method of producing the toner according to claim 1, comprising the steps of:

producing resin fine particles by dissolving the binder resin and the thermoplastic elastomer in an organic solvent and adding water to the resulting solution; and aggregating the obtained resin fine particles in an aqueous medium.

9. The toner according to claim 1, wherein the content of the thermoplastic elastomer in the toner is from at least 30 mass parts to not more than 60 mass parts expressed per 100 mass parts of the binder resin.

10. The toner according to claim 1, wherein the ester-type urethane thermoplastic elastomer has the structure indicated by the following general formula (2):

$$(\text{—O—R'—OCO—NH—R—NHCO—})_n \quad (2)$$

wherein, in the formula (2), R denotes an aromatic hydrocarbon or aliphatic hydrocarbon, and R' denotes a polyester.

* * * * *